US008311442B2

(12) United States Patent
Shida

(10) Patent No.: US 8,311,442 B2
(45) Date of Patent: Nov. 13, 2012

(54) IMAGE FORMING APPARATUS

(75) Inventor: Masanori Shida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 251 days.

(21) Appl. No.: 12/697,524

(22) Filed: Feb. 1, 2010

(65) Prior Publication Data

US 2010/0196026 A1 Aug. 5, 2010

(30) Foreign Application Priority Data

Feb. 3, 2009 (JP) ..... 2009-022721

(51) Int. Cl.
*G03G 15/16* (2006.01)

(52) U.S. Cl. ..... 399/101

(58) Field of Classification Search ..... 399/43, 399/99, 101

See application file for complete search history.

(56) References Cited

U.S. PATENT DOCUMENTS 7,215,920 B2 5/2007 Shida
7,313,335 B2 12/2007 Shida
7,403,729 B2 7/2008 Shida
7,437,088 B2 10/2008 Shida
7,486,900 B2 * 2/2009 Omata ..... 399/49
2009/0304403 A1 * 12/2009 Inada ..... 399/44

FOREIGN PATENT DOCUMENTS

JP 9-114274 A 5/1997
JP 2005-352041 A 12/2005

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

An image forming apparatus includes an image bearing member; toner image forming means for forming a toner image on the image bearing member; a transfer member for transferring the toner image from the image bearing member onto a recording material; an executing portion for executing a first cleaning mode in which the transfer member is cleaned by being supplied with a voltage of an identical polarity to a normal charge polarity of toner during non-image formation and executing a second cleaning mode in which the transfer member is cleaned by being supplied with a voltage of an opposite polarity to the normal charge polarity of the toner during the non-image formation; and a control portion for changing a ratio between a first cleaning mode execution period and a second cleaning mode execution period depending on an operation environment of the image forming apparatus.

11 Claims, 8 Drawing Sheets

IMAGE FORMING APPARATUS

FIELD OF THE INVENTION AND RELATED ART

The present invention relates to an image forming apparatus for transferring a toner image from an image bearing member onto a recording material by using a transfer roller.

An image forming apparatus in which the transfer roller is brought into contact with the image bearing member (a photosensitive member or an intermediary transfer member) to form a transfer portion at which the toner image is to be transferred onto the recording material has been widely used.

At a non-image portion of the image bearing member a small amount of fog toner is deposited even when the non-image portion is a white background portion at which the toner image is not formed, so that when image formation is effected in a cumulative manner, the fog toner is transferred onto the transfer to lose its electric charges, thus being accumulated gradually. Then, the toner accumulated on the transfer roller is rubbed off onto a backside (rear surface) of the recording material to be subjected to image formation, so that backside contamination is noticeable when the amount of the toner accumulated on the transfer roller exceeds a predetermined limit amount.

For this reason, in the conventional image forming apparatus, a dedicated cleaning device is provided to the transfer roller to prevent accumulation of the toner on the transfer roller (Japanese Laid-Open Patent Application (JP-A) 2005-352041).

However, when the dedicated cleaning device is provided at the transfer roller, a rotation load on the transfer roller is increased and a mechanism in the neighborhood of the transfer roller is complicated.

On the other hand, JP-A Hei 9-114274 proposes a cleaning mode in which a voltage is applied to the transfer roller at a feeding interval of the recording material (sheet interval) to transfer the toner accumulated on the transfer roller onto a photosensitive drum electrostatically.

In JP-A 2005-352041, a normal transfer voltage is applied to the transfer roller at the white background portion at the feeding interval of the recording material to prevent fog toner charged to an opposite polarity on the photosensitive drum from being transferred onto the transfer roller. However, the fog toner at the white background portion also contains toner charged to a regular polarity as described later, so that the toner charged to the regular polarity is transferred onto the transfer roller. For that reason, at a next feeding interval, by applying a voltage of the opposite polarity to that of the transfer voltage to the transfer roller, the toner charged to the regular polarity is returned from the transfer roller to the photosensitive drum. Thereafter, the fog toner prevented from being transferred onto the transfer roller and the fog toner of the regular polarity returned to the photosensitive drum are collected by a cleaning device provided adjacent to the photosensitive drum.

In the fog toner deposited at the white background portion of the image bearing member, a ratio between the toner charged to the regular polarity (regular polarity toner) and the toner charged to the opposite polarity (opposite polarity toner) is not generally constant. For example, in the case where the polarity of the regular polarity toner is positive, the polarity of the opposite polarity toner is negative.

Depending on a voltage condition set for the developing device and an image forming condition such as an environmental humidity, there exists a ratio between the regular polarity fog toner and the opposite polarity fog toner which are deposited at the white background portion of the image bearing member.

For this reason, by control in JP-A Hei 9-114274 in which the applied voltage to the transfer roller is inverted in polarity every feeding interval (sheet interval) of the recording material, the amounts of the fog toners moving between the image bearing member and the transfer roller every recording material feeding interval cannot be sufficiently cancelled. A difference in amount of the fog toners is accumulated, so that the fog toner is accumulated on the transfer roller to cause an occurrence of backside contamination of the recording material.

SUMMARY OF THE INVENTION

A principal object of the present invention is to provide an image forming apparatus in which a balance of amount of toner moving between an image bearing member and a transfer roller depending on a cleaning mode is impressed and the toner is less liable to be accumulated on the transfer roller.

Another object of the present invention is to provide an image forming apparatus in which backside contamination of the recording material is less liable to occur even when an image with a high image ratio is continuously formed at high speed.

A further object of the present invention is to provide an image forming apparatus improved in cleaning performance of toner deposited on a transfer member.

According to an aspect of the present invention, there is provided an image forming apparatus comprising:

an image bearing member;

toner image forming means for forming a toner image on the image bearing member;

a transfer member for transferring the toner image from the image bearing member onto a recording material;

an executing portion for executing a first cleaning mode in which the transfer member is cleaned by being supplied with a voltage of an identical polarity to a normal charge polarity of toner during non-image formation and executing a second cleaning mode in which the transfer member is cleaned by being supplied with a voltage of an opposite polarity to the normal charge polarity of the toner during the non-image formation; and a control portion for changing a ratio between a first cleaning mode execution period and a second cleaning mode execution period depending on an operation environment of the image forming apparatus.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings. The present invention can also be carried out in other embodiments in which a part or all of constitutions in the embodiments are replaced with their alternative constitutions so long as application times of voltages of positive and negative polarities applied to a transfer portion during non-image formation are different from each other.

Further, the image forming apparatus is not limited to those for forming a monochromatic image but may also be those, of a tandem type and a one-drum type, for forming a full-color image.

In this embodiment, only a principal portion associated with formation and transfer of a toner image is described but the present invention can be carried out in various fields of the image forming apparatus such as a printer, various printing machines, a copying machine, a facsimile machine, and a multi-function machine by adding necessary equipment, device, and a casing structure.

Incidentally, general matters of the image forming apparatuses described in JP-A 2005-352041 and JP-A Hei 9-114274 will be omitted from illustration and redundant explanation.

<Image Forming Apparatus>

Figure 1:
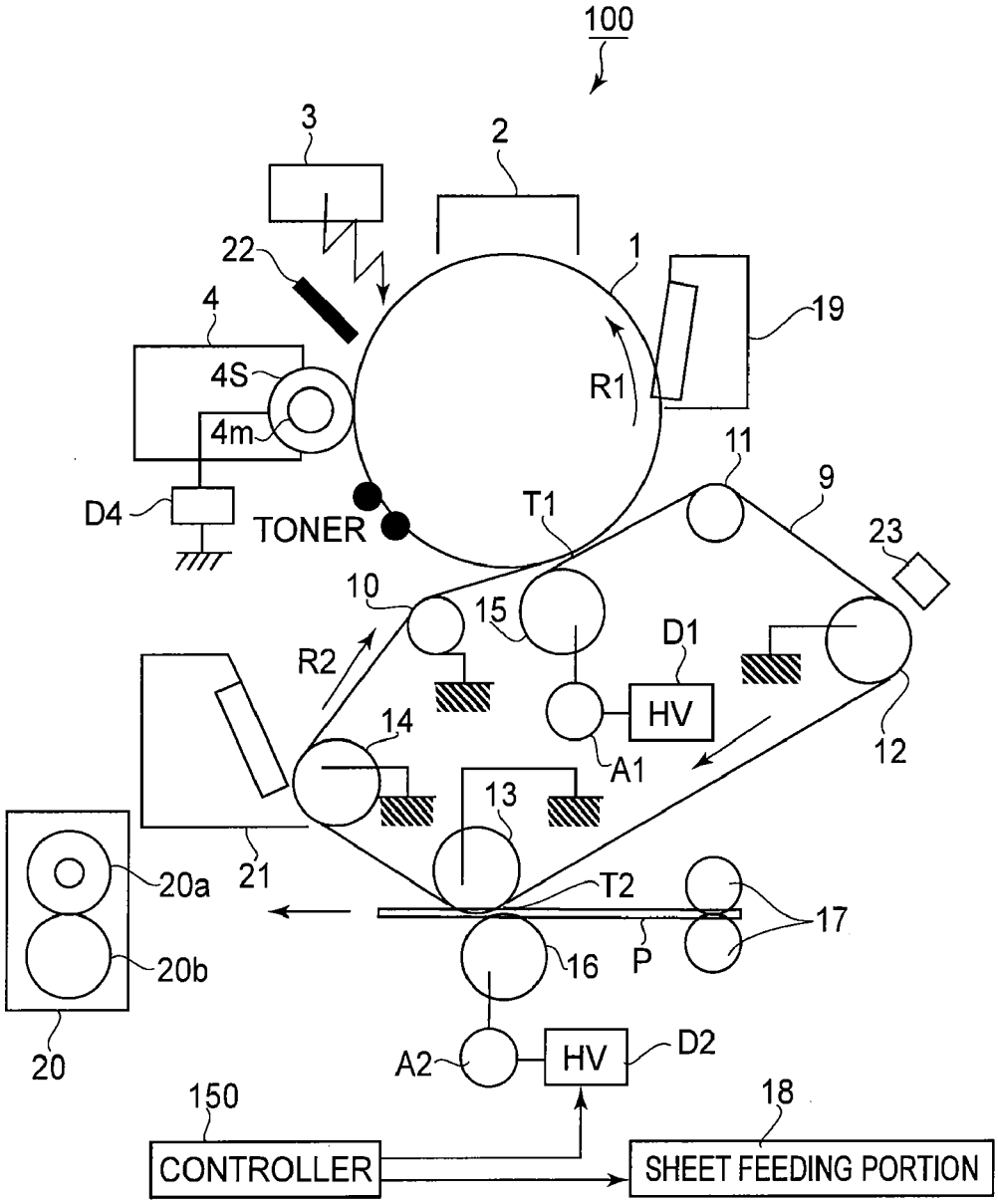
FIG. 1 is a schematic view for illustrating a constitution of an image forming apparatus.
Figure 2:
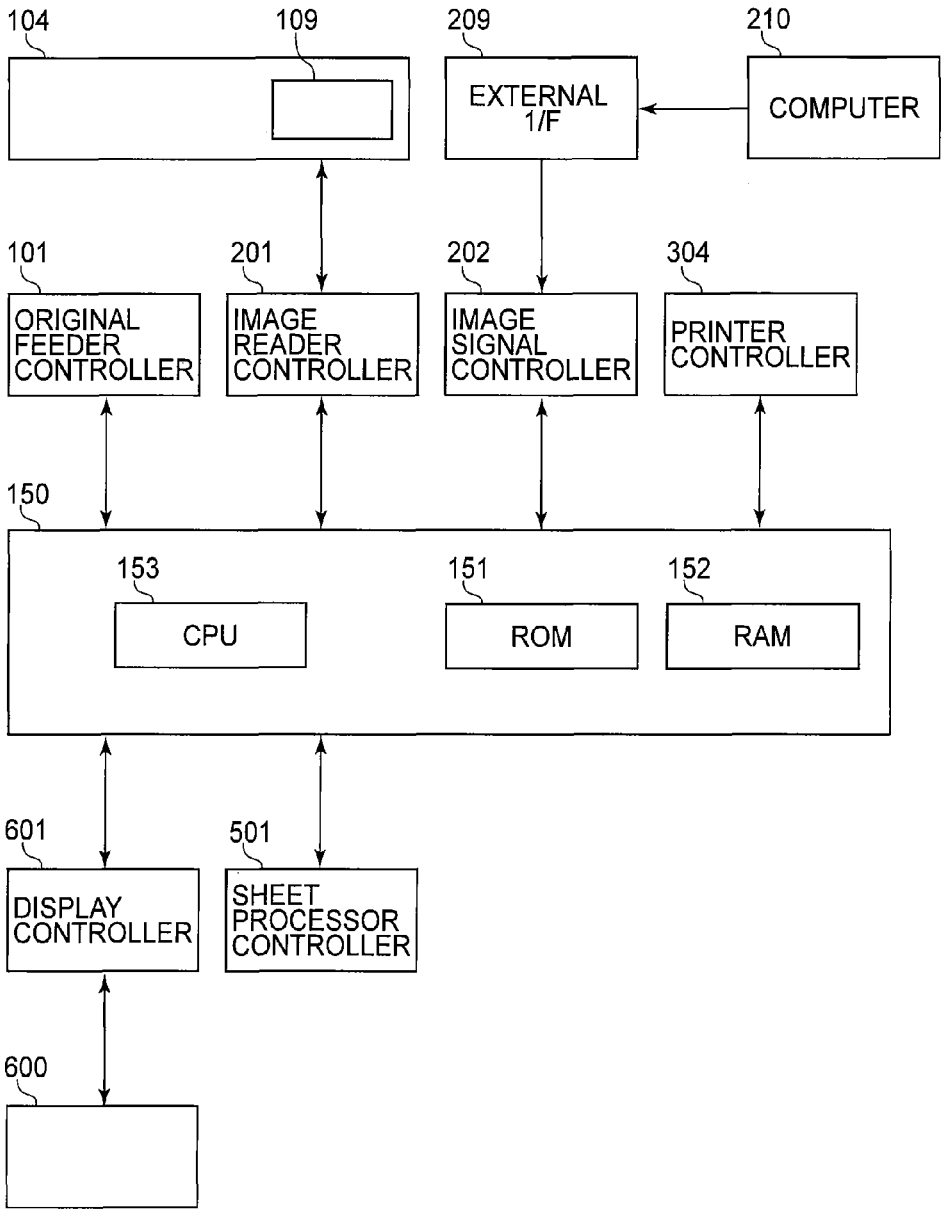
FIG. 2 is a block diagram of a control system of the image forming apparatus.

FIG. 1 is an explanatory view of a constitution of the image forming apparatus and FIG. 2 is a block diagram of a control system of the image forming apparatus.

As shown in FIG. 1, an image forming apparatus 100 in First Embodiment is a high-speed monochromatic printer in which a photosensitive drum 1 for black development color is disposed along an intermediary transfer belt 9.

A black toner image formed on the photosensitive drum 1 is primary-transferred onto the intermediary transfer belt 9 at a primary transfer portion T1 and is conveyed to a secondary transfer portion by the intermediary transfer belt 9. At the secondary transfer portion, the black toner image is secondary-transferred onto a recording material P. The recording material P on which the toner image is secondary-transferred is subjected to heat pressing by a fixing device 20 to have a fixed toner image on its surface and then is discharged to the outside of the apparatus.

Around the photosensitive drum 1, a corona charger 2, an exposure device 3, a developing device 4, a primary transfer roller 15, and a cleaning device 19 are disposed.

The photosensitive drum 1 is constituted by a metal cylinder having a surface on which a photosensitive layer with a negative charge polarity and is rotated in a direction indicated by an arrow R1 at a process speed of 300 mm/sec.

The corona charger 2 electrically charges the surface of the photosensitive drum 1 uniformly to a potential of a negative polarity by irradiating the photosensitive drum 1 surface with charged particles by corona discharge.

The surface of the photosensitive drum 1 is scanned with a laser beam, obtained by on-off modulation of scanning line image data developed from image data, through a polygonal mirror by the exposure device 3, so that an electrostatic image for an image is formed on the charged surface of the photosensitive drum 1.

The developing device 4 carries a one-component developer (magnetic toner) on a developing sleeve 4*s* rotating about a fixed magnetic pole 4*m*.

A power source D4 applies an oscillating voltage in the form of a negative DC voltage biased with an AC voltage. As a result, the magnetic toner is transferred onto the photosensitive drum 1 at an exposed portion which is positive relative to the developing sleeve 4*s*, thus reversely developing the electrostatic image.

The primary transfer roller 15 is urged toward the photosensitive drum 1 with a predetermined urging force to form the primary transfer portion between the photosensitive drum 1 and the intermediary transfer belt 4 while sandwiching the intermediary transfer belt 4 between it and the photosensitive drum 1.

A power source D1 applies a positive DC voltage to the primary transfer roller 15. As a result, the toner image negatively charged and carried on the photosensitive drum 1 is primary-transferred onto the intermediary transfer belt 9.

The recording material P separated and fed one by one waits at a position of registration rollers 17 and is sent to the secondary transfer portion T2 while being timed to the toner image on the intermediary transfer belt 9.

A secondary transfer roller 16 as an example of the transfer roller is urged toward an opposing roller 13 with a predetermined urging force and contacts the intermediary transfer belt 9 supported by the opposing roller from the inside of the intermediary transfer belt 9, thus forming the secondary transfer portion. At the secondary transfer portion, the toner image carried on the intermediary transfer belt 9 is superposed on the recording material P and the recording material is nip-conveyed.

The secondary transfer roller 16 is connected to a power source D2 and on the other hand, the opposing roller 13 is connected to a ground potential. The power source D2 applies a positive DC voltage to the secondary transfer roller 16. As a result, the toner image negatively charged and carried on the intermediary transfer belt 9 is secondary-transferred onto the recording material P.

The cleaning device 19 rubs with a cleaning blade the surface of the photosensitive drum 1 having passed through the primary transfer portion T1, thus removing untransferred toner deposited on the photosensitive drum 1. A belt cleaning device 21 rubs with a cleaning blade the intermediary transfer belt 9 having passed through the secondary transfer portion T2, thus removing untransferred toner deposited on the intermediary transfer belt 9. An optical sensor 23 optically detects a density of the toner image (patch image) which has been primary-transferred onto the intermediary transfer belt 9.

<Transfer Portion>

The intermediary transfer belt 9 as an example of the image bearing member (image carrying member) is stretched and supported by a tension roller 12, an opposing roller 13, a driving roller, and stretching rollers 10 and 11 and is driven and rotated in a direction indicated by an arrow R2 by the driving roller 14. The stretching rollers 10 and 11 are metal-made follower rollers disposed in the neighborhood of the primary transfer portion and form a flat primary transfer surface of the intermediary transfer belt 9. The tension roller 12 controls a tension of the intermediary transfer belt 9 at a constant level.

The intermediary transfer belt 9 may be an endless belt adjusted in volume resistivity at $1\times10^{8}$ ohm·cm to $1\times10^{13}$ ohm·cm by incorporating an appropriate amount of carbon black as an antistatic agent into a 0.08 mm-thick film of polyimide. The intermediary transfer belt 9 may also be prepared by using various resin or rubber materials of polycarbonate, polyester, polypropyrene, polyethylene terephthalate, acrylic polymer, vinyl chloride resin, and the like and by being formed in a thickness of 0.07 mm to 0.1 mm.

The secondary transfer roller 16 may be formed with an outer diameter of 24 mm by disposing a 6 mm-thick elastic layer on an outer surface of a metal-made center shaft member with a diameter of 12 mm. The elastic layer may be an urethane rubber foam layer, with a cell diameter of 0.05 mm to 1.0 mm, in which carbon black is dispersed, and may be adjusted in resistance at $5\times10^5$ ohm/cm.

The power source D2 applies to the secondary transfer roller 16 the positive DC voltage used for transferring the toner image and the negative DC voltage having the same absolute value at that of the positive DC voltage in a switching manner. The DC voltage used for transferring the toner image is automatically set by measuring a current under application of a test voltage at a plurality of levels in a state in which the recording material P is not present and then by subjecting the test voltage to interpolation computation so as to provide a predetermined transfer voltage.

<Control Portion>

As shown in FIG. 2, a control portion (executing portion) 150 executes image formation by controlling the image forming apparatus 100 shown in FIG. 1.

The control portion 150 includes a CPU circuit portion 153 and contains an ROM 151 and an RAM 152. The ROM 151 stores an image formation control program and various data for image formation. The RAM 152 temporarily holds control data and is used as a working area for processing (computation) associated with the control. The CPU circuit portion 153 executes necessary computation and control on the RAM 152 by using the control program and various data read from the ROM 151 and effects multiple unit control of a continuous image formation process.

An original feeding device control portion 101 effects drive control of an original feeding portion on the basis of instructions provided from the control portion 150.

An image reader control portion 201 effects drive control of a scanner unit 104, an image sensor 109, and the like and transfers analog image signals output from the image sensor 109 to an image signal control portion 202.

The image signal control portion 202 converts the analog image signals into digital image signals to perform various processing processes. Further, the image signal control portion 202 subjects the digital image signals input from a computer 210 through an external interface (I/F) 209 to various processing processes. The processing operation by the image signal control portion 202 is controlled by the control portion 150.

The digital image signals subjected to the various processing processes are converted into video signals to be output to a printer control portion 304. The printer control portion 304 drives an exposure control portion for the exposure device 3 (FIG. 1) on the basis of the input video signals. Further, the printer control portion 304 subjects the video signals to video count processing to compute an image ratio described later.

An operation and display device control portion 601 effects exchange of information between an operation and display device 600 and the control portion 150. For example, the operation and display device control portion 601 outputs key signals, corresponding to respective keys of the operation and display device 600, to the control portion 150 and outputs information to be displayed from the control portion 150 to the operation and display device 600 so as to be displayed by the operation and display device 600.

<Cleaning Mode>

Figure 3:
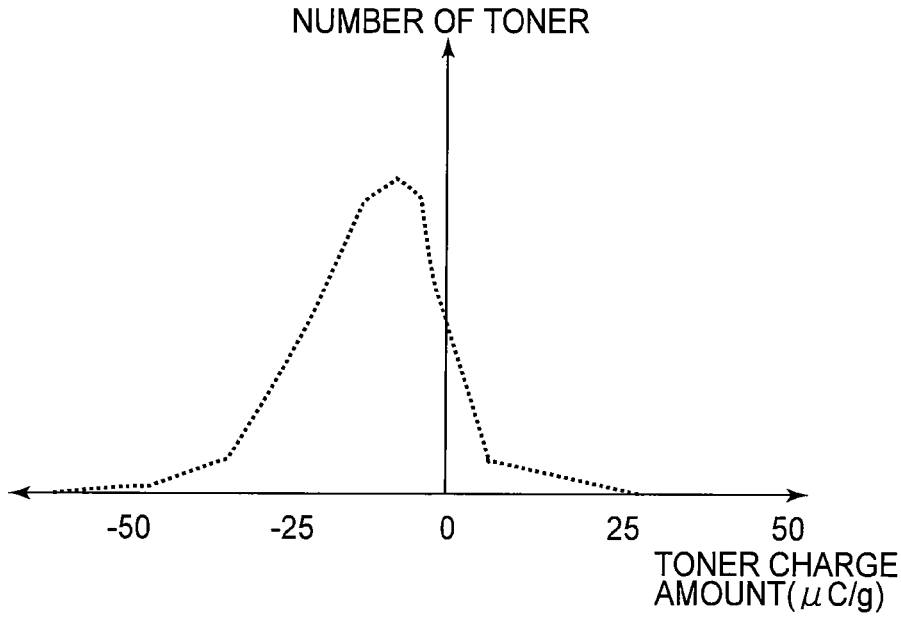
FIG. 3 is a graph showing a measurement result of a distribution of charge amount of fog toner on an intermediary transfer belt.
Figure 4:
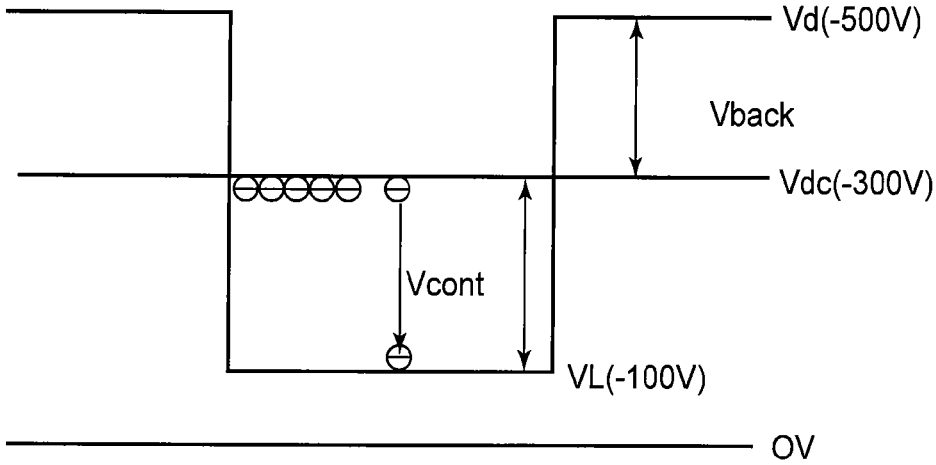
FIG. 4 is a schematic view for illustrating a developing contrast and a fog-removing contrast.
Figure 5:
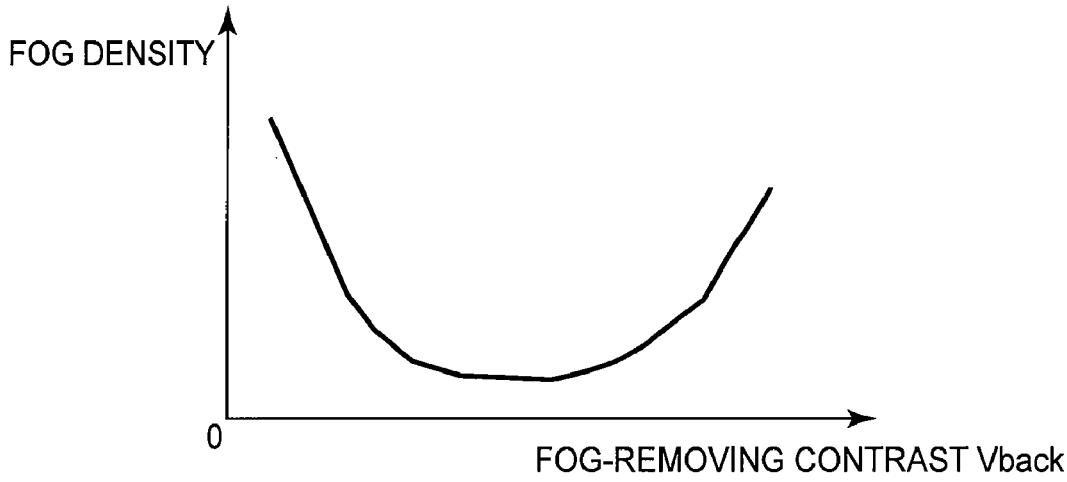
FIG. 5 is a graph showing a relationship between the fog-removing contrast and a developing fog density.

FIG. 3 is an explanatory view of a result of measurement of a toner charge amount distribution of the fog toner on the intermediary transfer belt. FIG. 4 is an explanatory view of a developing contrast and a fog-removing contrast. FIG. 5 is an explanatory view of a relationship between the fog-removing contrast and a developing fog density.

In recent years, in correspondence with POD (print demand), image forming apparatuses with high speed and high image quality have made advances, so that a printer, a copying machine, and the like capable of meeting high-speed and large-volume jobs have been developed.

In the image forming apparatus for executing high-speed and large-volume continuous image formation in a short time, the secondary transfer roller 16 is always in contact with the intermediary transfer belt 9 during the continuous image formation. For this reason, at a sheet interval in which the recording material P is not located between the secondary transfer roller 16 and the intermediary transfer belt 9, the surface of the secondary transfer roller 16 is contaminated with the fog toner deposited on the intermediary transfer belt 9.

The fog toner deposited on the intermediary transfer belt 9 results from the fog toner, deposited at a white image portion of the photosensitive drum 1 in the developing process of the electrostatic image by the developing device, conveyed to the primary transfer portion T1 and being transferred onto the intermediary transfer belt 9.

The regular charge polarity of the toner is negative (−), so that most of the toner in a developing device 4*a* is also negative (−) (regular polarity). For this reason, as shown in FIG. 3, most of the fog toner deposited on the intermediary transfer belt 9 is also negative (−) (regular polarity). The charge amount distribution of the fog toner is measured by sucking the fog toner from the surface of the intermediary transfer belt 9 by using a particle charge amount measuring device ("Espart Analyzer" (trade name), mfd. by Hosokawa Micron Corporation).

As shown in FIG. 4 with reference to FIG. 1, the electrostatic image is formed on the photosensitive drum 1 by lowering a dark portion potential Vd (−500 V) of the charged surface of the photosensitive drum 1 to a light portion potential VL (−100 V) through light exposure. Thereafter, an oscillating voltage in the form of a DC voltage Vdc (−300 V) biased with an AC voltage is applied to the developing sleeve 4*s*, so that the negatively charged (−) toner is deposited at a portion of the light portion potential VL which is positive relative to the DC voltage Vdc.

Here, a potential difference (200 V) between the DC voltage Vdc and the light portion potential VL is a developing contrast Vcont for forming an image at a maximum density. Further, a potential difference (−200 V) between the DC voltage Vdc and the dark portion potential Vd is a minimum image density, i.e., a fog-removing contrast Vback for returning the negatively charged (−) toner to the developing sleeve 4*s* to form a white background portion.

As shown in FIG. 5 with reference to FIG. 1, in the case where the fog-removing contrast Vback is low, an effect of returning the negatively charged (−) toner to the developing sleeve 4*s* is small, so that the negatively charged (−) toner deposited on the white background portion is increased in amount and a fog density is increased.

However, in an area in which the fog-removing contrast Vback is high, as shown in FIG. 3, the positively charged (+) toner contained in the developer in a small amount is transferred from the developing sleeve 4*s* onto the photosensitive drum 1 in response to the fog-removing contrast Vback. For this reason, the DC voltage Vdc is set correspondingly to the fog-removing contrast Vback providing the lowest fog density during the development. However, there is a possibility that an actual fog-removing contrast is fluctuated depending on factors such as non-uniformity of the dark portion potential Vd of the photosensitive drum 1, and fluctuations in developing condition, toner charge amount, toner charge amount distribution, and the like.

Then, the fog toner on the photosensitive drum 1 is primary-transferred from the photosensitive drum 1 onto the intermediary transfer belt 9 by the positive bias applied to the primary transfer roller. At this time, the fog toner on the photosensitive drum 1 is subjected to selection by the positive bias.

As described above, the fog toner on the photosensitive drum 1 contains the toner negatively charged to the regular polarity and the toner positively charged to the opposite polarity. In the fog toner primary-transferred onto the intermediary transfer belt 9 by the positive bias, the negatively charged fog toner is increased in amount.

The positively charged fog toner of the fog toner on the photosensitive drum 1 is electrostatically repulsive to the positive bias except for the cases of deposition transfer by pressure application to the primary transfer roller 15 and transfer thereof together with the negatively charged fog toner in mixture, so that an amount of the toner to be transferred is small. For this reason, in the fog toner on the intermediary transfer belt 9, as shown in FIG. 3, the negatively charged fog toner is dominant. The fog toner on the intermediary transfer belt 9 in which the negatively charged fog toner is dominant is transferred onto the recording material P by being attracted by the positive bias applied to the secondary transfer roller 16 when the recording material P is located at the secondary transfer portion T2.

However, at the feeding interval of the recording material P at which the recording material P is not present at the secondary transfer portion T2, the negatively charged fog toner is attracted by the positive bias applied to the secondary transfer roller 16, thus being transferred onto the secondary transfer roller 16. With timing at which the recording material P is not present at the secondary transfer portion T2, when the positive bias is applied to the secondary transfer portion T2, the fog toner of the regular polarity on the intermediary transfer belt 9 is attracted to the secondary transfer roller 16. For this reason, when the high-speed and large-volume continuous image formation is executed in a short time, the secondary transfer roller 16 is quickly contaminated with the fog toner, so that backside contamination of the recording material P occurs in a short period of time.

Therefore, in the image forming apparatus 100, the negatively charged fog toner deposited on the secondary transfer roller 16 is electrostatically removed by applying the negative bias of an identical polarity to the regular polarity of the toner. In order to discharge the regular polarity fog toner on the secondary transfer roller 16 to the intermediary transfer belt 9, the negative bias is applied to the secondary transfer roller 16 with timing at which the recording material P is not present at the secondary transfer portion T2. By applying the negative bias to the secondary transfer roller 16, repulsion of the toner deposited on the secondary transfer roller 16 is caused to occur, so that the toner is forcedly returned to and deposited on the intermediary transfer belt 9.

On a downstream side of the secondary transfer portion T2, the belt cleaning device 21 for removing the untransferred toner deposited on the intermediary transfer belt 9 is provided. In a cleaning mode of the secondary transfer roller 16, the fog toner deposited on the intermediary transfer belt 9 is collected from the intermediary transfer belt 9 by the belt cleaning device 21.

COMPARATIVE EMBODIMENTS

Figure 6:
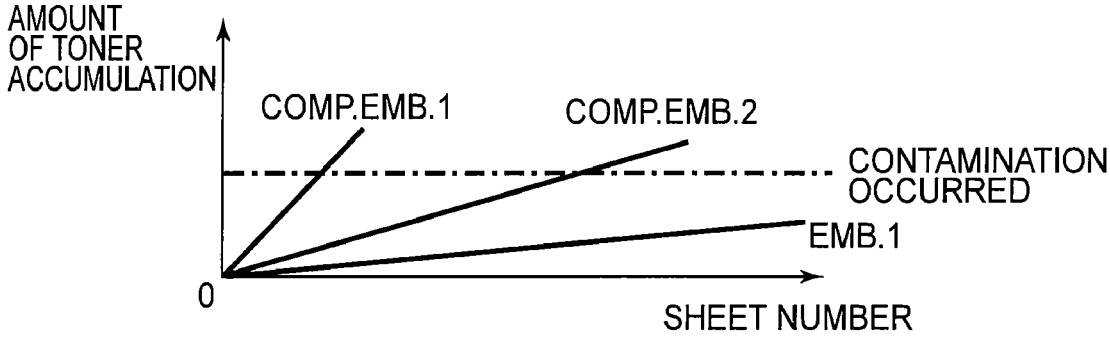
FIG. 6 is a graph for illustrating cleaning modes in Comparative Embodiments.

FIG. 6 is an explanatory view of a cleaning mode in Comparative Embodiments.

As shown in FIG. 1, the image forming apparatus 100 executes a first cleaning mode or a second cleaning mode at a feeding interval of the recording material P contained in a period of one continuous image formation operation.

In the first cleaning mode, at the feeding interval of the recording material P, the negative bias is applied to the secondary transfer roller 16 to return the fog toner of the regular polarity deposited on the secondary transfer roller 16 to the intermediary transfer belt 9. However, at the same time, the toner of the opposite polarity occupying 20% of the entire fog toner deposited on the intermediary transfer belt 9 is transferred onto the secondary transfer roller 16.

In the second cleaning mode, at the feeding interval of the recording material P, the positive bias is applied to the secondary transfer roller 16 to return the fog toner of the opposite polarity deposited on the secondary transfer roller 16 to the intermediary transfer belt 9. However, at the same time, the toner of the regular polarity occupying 80% of the entire fog toner deposited on the intermediary transfer belt 9 is transferred onto the secondary transfer roller 16.

As shown in FIG. 6 with reference to FIG. 1, in Comparative Embodiment 1, only the first cleaning mode was repeated every feeding interval of the recording material P. In Comparative Embodiment 2, as described in JP-A 2005-352041, the first cleaning mode and the second cleaning mode were alternately repeated every feeding interval of the recording material P.

In Comparative Embodiment 1, the fog toner of the regular polarity is not returned from the secondary transfer roller 16 to the intermediary transfer belt 9. For this reason, the fog toner of the regular polarity is continuously accumulated one-sidedly, so that the secondary transfer roller 16 is quickly contaminated with the fog toner and thus the backside contamination of the recording material P in a very short period of time.

In Comparative Embodiment 2, with respect to the fog toner of the opposite polarity transferred onto the secondary transfer roller 16 in the first cleaning mode, the fog toner is substantially completely returned to the intermediary transfer belt 9 in the second cleaning mode. However, with respect to the fog toner of the regular polarity transferred onto the secondary transfer roller 16 in the second cleaning mode, only a part of the fog toner is returned to the intermediary transfer belt 9.

For this reason, the regular polarity fog toner which is not returned is accumulated on the secondary transfer roller 16, which is gradually contaminated with the fog toner and thus the backside contamination of the recording material P is caused to occur in a relatively short period of time.

In other words, in the case where the toner with the same charge amount and charge polarity is transferred by using the same transfer voltage, a transfer efficiency of the toner from the transfer roller having a sponge texture onto a smooth image bearing member is lower than that with respect to an opposite direction. For this reason, in the case where a total time in which the first cleaning mode is executed is equal to a total time in which the second cleaning mode is executed, the toner having the dominant charge polarity which has not been returned is gradually accumulated on the transfer roller.

In Comparative Embodiment 2, if the amount of the regular polarity fog toner is equal to that of the opposite polarity fog toner, even when the total time of the first cleaning mode is equal to that of the second cleaning mode, the regular polarity fog toner alone is not excessively accumulated on the transfer roller.

However, actually, as shown in FIG. 3, a possibility that the amount of the regular polarity fog toner coincides with that of the opposite polarity fog toner is low. For this reason, in Comparative Embodiment 2, the occurrence of the backside contamination of the recording material P cannot be avoided.

In the case where a ratio of the regular polarity fog toner to the opposite polarity fog toner is 4/1, the regular polarity fog toner transferred in a large amount onto the transfer roller in the second cleaning mode is left on the transfer roller in a considerable amount only by one time execution of a subsequent first cleaning mode. On the other hand, in the case where the opposite polarity fog toner transferred in a small amount onto the transfer roller in the first cleaning mode, the opposite polarity fog toner is little left on the transfer roller only by one time execution of a subsequent second cleaning mode. That is, in the control in Comparative Embodiment 2, a cleaning performance in the second cleaning mode leaves a margin and on the other hand, the cleaning performance in the first cleaning mode is insufficient.

In the following Embodiment 1, during the continuous image formation for forming an image on the recording material in succession, the transfer member is cleaned by applying a voltage to the transfer member during an image forming operation similarly as in Comparative Embodiment 2. However, by decreasing the number of executions of the second cleaning mode compared with that in Comparative Embodiment 2, the amount of the regular polarity fog toner transferred onto the secondary transfer roller 16 is decreased. Further, by increasing the number of executions of the first cleaning mode, the regular polarity fog toner transferred onto the secondary transfer roller 16 is returned to the intermediary transfer belt 9 in a plurality of times of operations with reliability. As shown in FIG. 3, a proportion of the negatively charged toner in the fog toner deposited on the intermediary transfer belt 9 is high, the accumulation of the negatively charged toner on the secondary transfer roller 16 is prevented preferentially.

Embodiment 1

Figure 7:
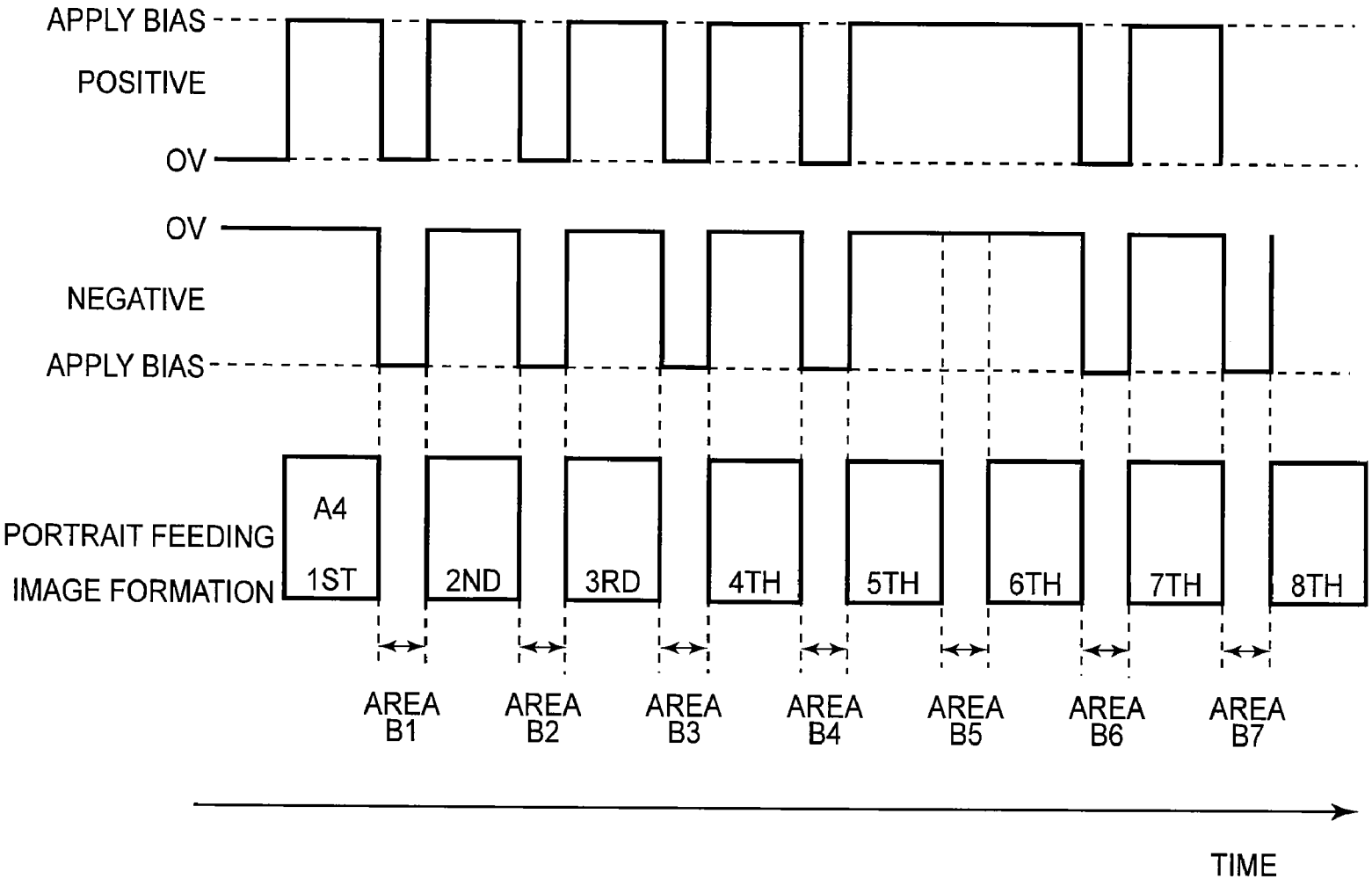
FIG. 7 is a timing chart of control in Embodiment 1.
Figure 8:
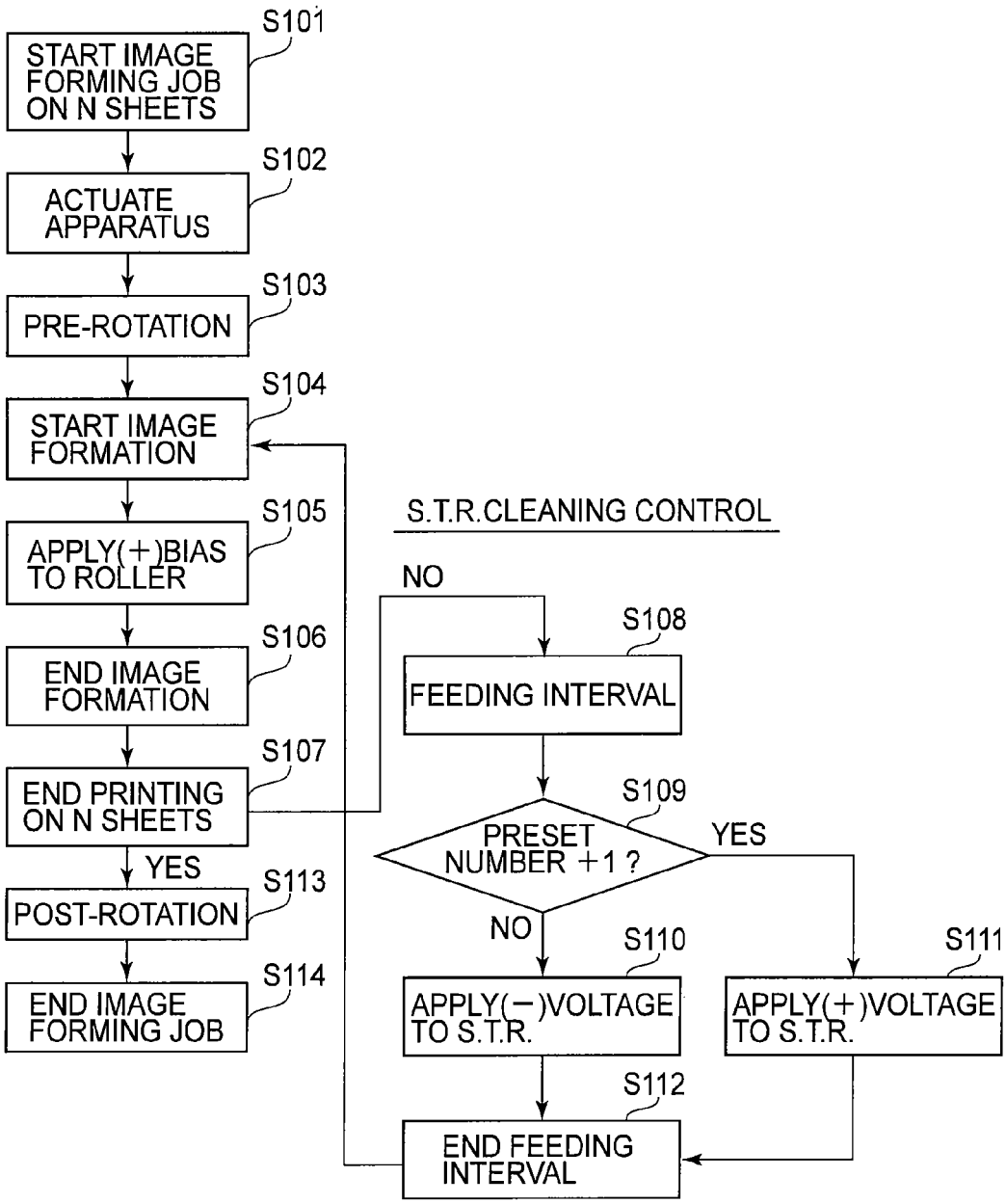
FIGS. 8 and 9 are flow charts each of control in Embodiment 1.

FIG. 7 is a timing chart of control in Embodiment 1 and FIG. 8 is a flow chart of the control in Embodiment 1.

As shown in FIG. 3, of the fog toner deposited on the intermediary transfer belt 9, the negatively charged toner with the regular polarity is 80% and the positively charged toner with the opposite polarity is 20%.

In Embodiment 1, a bias to be applied at a feeding interval to a recording material (A4 size) in continuous image formation (portrait feeding mode) is set every feeding interval but 80% of the entire feeding interval is set as a negative bias and 20% of the entire feeding interval is set as a positive bias. Each feeding interval of the recording material is kept constant at 100 mm, which is larger than a peripheral (circumferential) length (75 mm) of the transfer roller 16.

That is, in the case where successive five feeding intervals in the continuous image formation is considered as one set, the negative bias for permitting returning of the negatively charged toner deposited on the secondary transfer roller 16 to the intermediary transfer belt 9 is applied at the four feeding intervals of the five feeding intervals.

Further, at the remaining one feeding interval of the five feeding intervals, the positive bias is applied to the secondary transfer roller 16. In the case of the continuous image formation on 10 sheets, the above operations are performed two times. In the case of the continuous image formation on 1000 sheets, the above operations are performed 200 times.

As shown in FIG. 7 with reference to FIG. 1, in Embodiment 1, in the case of the continuous image formation on 10 sheets or more, at feeding intervals B1 to B4 corresponding to first 4 sheets, the negative bias which has the same absolute value and an opposite polarity to the positive bias as the secondary transfer bias is applied. By the bias application at the feeding intervals B1 to B4, the negatively charged toner present on the intermediary transfer belt 9 is repelled, so that the secondary transfer roller 16 is not contaminated with the negatively charged toner.

On the other hand, the positively charged T present on the intermediary transfer belt 9 is deposited on the secondary transfer roller 16 but the proportion thereof to the entire fog toner is merely 20%, so that the secondary transfer roller 16 is not extremely contaminated with the positively charged toner.

Then, at a feeding interval B5 after the fifth recording material sheet passes, the positive bias of the same polarity at that of the secondary transfer bias is applied. As a result, the positively charged toner accumulated at the feeding intervals B1 to B4 is transferred onto the intermediary transfer belt 9 and is collected in the belt cleaning device 21.

At the feeding interval B5, the positively charged toner on the intermediary transfer belt 9 is repelled, so that the positively charged toner is not transferred onto the secondary transfer roller 16. However, the negatively charged toner present in a large amount on the intermediary transfer belt 9 is deposited on the secondary transfer roller 16 in a considerable amount.

For this reason, at four feeding intervals of sixth sheet or later, the negative bias for permitting repulsion of the negatively charged toner is applied again to the secondary transfer roller 16 to transfer the negatively charged toner from the secondary transfer roller 16 onto the intermediary transfer belt 9 in four times of operations. Then, at a feeding interval after a ninth sheet passes, similarly as in the case of the feeding interval B5, the positive bias is applied to the secondary transfer roller 16 to transfer the positively charged toner accumulated at the preceding four feeding intervals from the secondary transfer roller 16 to the intermediary transfer belt 9.

As shown in FIG. 8 with reference to FIG. 1, the control portion 150 actuates the image forming apparatus (S102) when an instruction for image formation is provided (S101), thus executing pre-rotation (S103).

The control portion 150 starts image formation using the photosensitive drum 1 (S104) and applies the positive bias to the secondary transfer roller 16 to execute the secondary transfer (S105).

The control portion 150 confirms, when the image formation is ended (S106), whether or not the printing on N sheets is completed (S107). When the printing on N sheets is completed (YES of S107), post-rotation is performed (S113) and the continuous image formation is ended (S114).

When the printing on N sheets is not completed (NO of S107), the control portion 150 executes the cleaning mode of the secondary transfer roller 16 at feeding intervals (sheet intervals) (S108).

The control portion 150 judges whether or not a predetermined number of execution of the first cleaning mode is completed (S109). As described above, in Embodiment 1, image formation on 5 sheets is taken as one cycle on the basis of the distribution of toner charge amount shown in FIG. 3, and the negative bias is applied four times and the positive bias is applied one time.

When the execution number of the first cleaning mode is (predetermined number)+1 (YES of S109), the positive bias is applied to the secondary transfer roller 16 (S111). However, until the predetermined number, the negative bias is applied to the secondary transfer roller 16 (S110).

The control portion 150 starts subsequent image formation (S104) when the above-described secondary transfer roller cleaning control at the feeding intervals (S112).

In the control in Embodiment 1, the number of bias application in one cycle of the control was set at 5 correspondingly to the ratio of (negatively charged toner)/(positively charged toner) of 8/2 obtained by actually measuring the charge amount distribution of the fog toner. The first cleaning mode and the second cleaning mode were regularly repeated minimum times satisfying the ratio of the number of feeding intervals in which the first cleaning mode is executed to the number of feeding intervals in which the second cleaning mode is executed.

As a result, the electric charge of the fog toner transferred on the secondary transfer roller 16 is attenuated and the fog toner is returned to the intermediary transfer belt 9 before the electrostatic transfer thereof becomes impossible, so that the toner which has lost the electric charge is less liable to be accumulated on the secondary transfer roller 16.

However, the one set is not limited to 5 times (of bias application) but may also be 10 times in which the negative bias is applied 8 times and then the positive bias is applied 2 times. Further, the one set may also be 50 times in which the negative bias is applied 40 times and then the positive bias is applied 10 times. The distribution of the one cycle can be appropriately changed so long as the ratio of (total number of negative bias application):(total number of positive bias application) is 8:2.

The number of bias applications for the one set and the number of repetitions of the same-polarity bias application may be set on the basis of a balance between an electrostatic cleaning performance and toner accumulating performance without causing the occurrence of the backside contamination of the secondary transfer roller 16.

As described above, as a normal condition, on the basis of the actually measured values of the charge amount distribution of the fog toner on the intermediary transfer belt 9, the distribution between the first cleaning mode and the second cleaning mode was set.

Then, on the basis of the control in Embodiment 1 in which the normal condition is assumed, the distribution between the first cleaning mode and the second cleaning mode is adjusted depending on factors (1) to (6) by which the charge amount distribution of the fog toner is changed.

The distribution between the first cleaning mode and the second cleaning mode is adjusted depending on an image forming condition including a cumulative number of sheets subjected to the image formation, an image ratio, a continuous rest time, environmental temperature and humidity with respect to the developing device. Specifically, under the image forming condition in which the toner charge amount is decreased, the amount of the opposite polarity fog toner is increased, so that the ratio of the first cleaning mode is lowered. Further, under the image forming condition in which the amount of the toner charge amount is increased, the amount of the regular polarity fog toner is increased, so that the ratio of the second cleaning mode is lowered.

(1) When the number of image formation with respect to the developing device is increased, the developer in the developing container is deteriorated and thus the toner charging performance is lowered, so that the distribution of the toner charge amount is shifted to the opposite polarity side as a whole. For this reason, the proportion of the positively charged toner to the fog toner on the intermediary transfer belt 9 is increased.

(2) With respect to the image with a low image ratio, a ratio of the white background is high and thus an amount of toner consumption is low, so that when the continuous image formation with the low image ratio is continued, it takes much time until the toner in the developing container is subjected to the development on the photosensitive drum 1. Therefore, the toner charge amount distribution is shifted to the regular polarity side as a whole correspondingly to an increase in opportunity in which the toner is stirred and triboelectrically charged in the developing container. For this reason, the proportion of the positively charged toner to the fog toner on the intermediary transfer belt 9 is lowered.

Incidentally, the image ratio refers to a parameter of an amount of toner for the entire image obtained by video count processing of a video signal or dot count processing of an exposure signal. The image ratio of a whole surface image with a maximum density (e.g., a solid black image) is taken as 100 and is defined as a numerical value (%) of a cumulative density value on the whole surface for each image. For example, the image ratio is 3-5% in the case of an ordinary character image and is about 200% in the case of a whole surface (four color-based) full-color image with the maximum density.

(3) The image with the high image ratio consumes a large amount of the toner, so that when the continuous image formation with the high image ratio is continued, the toner in the developer container is subjected to the development on the photosensitive drum 1 without being triboelectrically charged sufficiently. For this reason, the proportion of the positively charged toner to the fog toner on the intermediary transfer belt 9 is increased.

(4) When the image forming apparatus is left standing for a long term in the rest state, during the continuous image formation immediately after the actuation, the toner charge amount is lowered by the influence of the long-term standing and thus the toner charge amount distribution is shifted to the opposite polarity side as a whole. For this reason, the proportion of the positively charged toner to the fog toner on the intermediary transfer belt 9 is increased.

(5) In a low humidity environment, the content of water in the toner is small and thus the toner charge performance is enhanced, so that the toner charge amount distribution is shifted to the regular polarity side as a whole. For this reason, the proportion of the positively charged toner to the fog toner on the intermediary transfer belt 9 is lowered.

(6) In a high humidity environment, the content of water in the toner is increased, so that the electric charge of the toner is liable to attenuate. Thus, the toner charge amount distribution is shifted to the opposite polarity side as a whole. For this reason, the proportion of the positively charged toner to the fog toner on the intermediary transfer belt 9 is increased.

Figure 9:
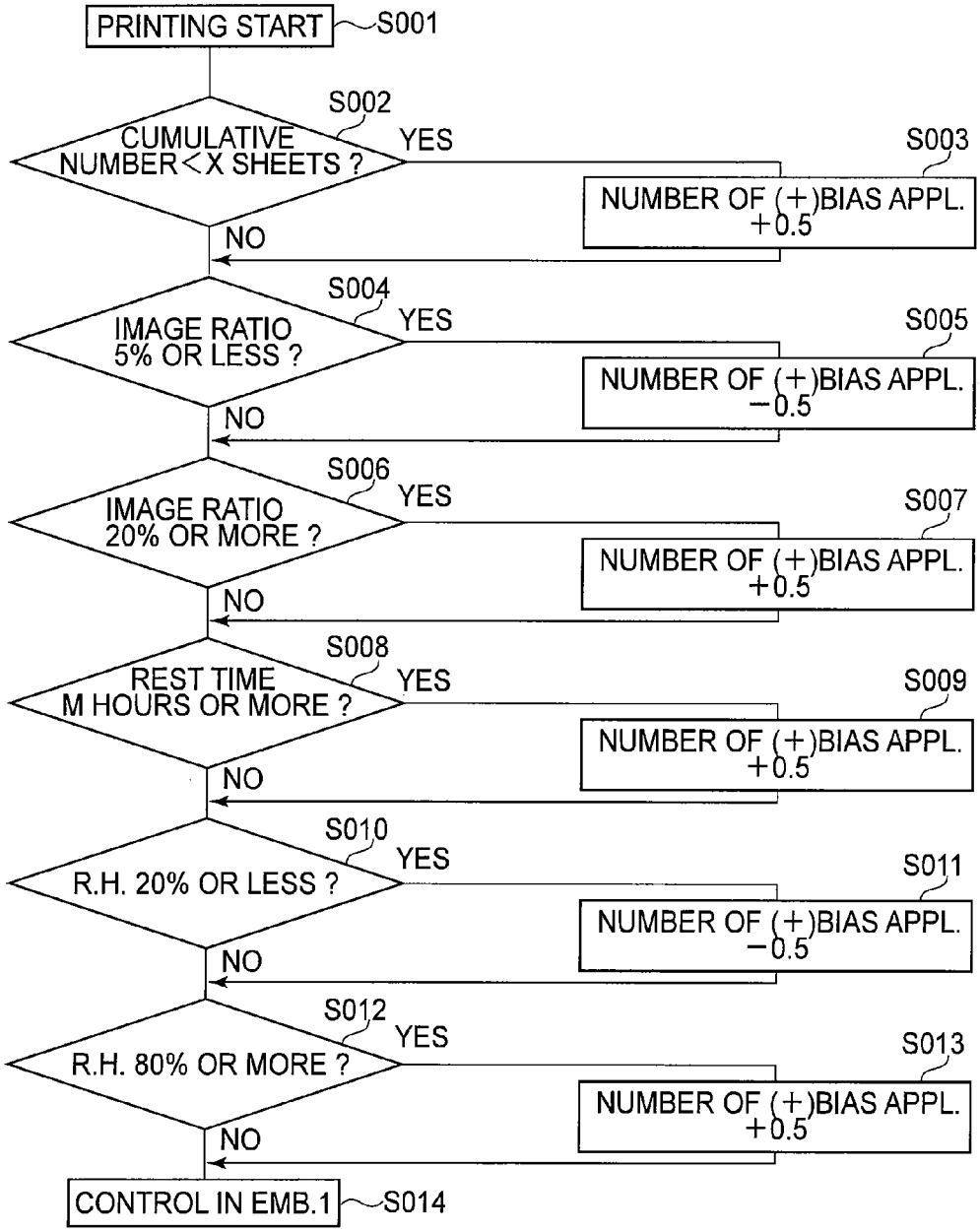

As shown in FIG. 9 with reference to FIG. 1, the control portion 150 adjusts a polarity ratio of the bias to be applied to the secondary transfer roller 16 at the feeding intervals of the recording material depending on the above-described conditions (factors) (1) to (6). Then, by using the above-described adjusted polarity ratio, the control in Embodiment 1 shown in FIG. 8 is effected.

The control portion 150 judges, when a copy start signal is input (S001), the ratio between the positive bias and the negative bias from the cumulative number of sheets subjected to the image formation with respect to the developing device (S002). When the number of image formation exceeds X (10,000 sheets) (YES of S002), the amount of the positively charged fog toner is increased as described above in (1).

Therefore, the number of positive bias application at 10 feeding intervals in two cycles described in Embodiment 1 is increased by 0.5 (S003). When the ratio of the negative bias application number of the positive bias application number is 8/2 before the adjustment, the number of bias application is adjusted so that the number of negative bias application is 7.5 and that of positive bias application is 2.5.

Then, the control portion 150 judges the ratio between the positive and negative bias application numbers from the image ratio of the image subjected to the continuous image formation in an input image forming job (S004).

When the continuous image formation of the image with the image ratio of 5% or less is effected, as described above in (2), the amount of the positively charged fog toner is decreased. For this reason, the control portion 150 decreases, when the image ratio is judged as being 5% or less (YES of S004), the number of the positive bias application by 0.5 (S005).

When the continuous image formation of the image with the image ratio of 20% or more is effected, as described above in (3), the amount of the positively charged fog toner is increased. For this reason, the control portion 150 increases, when the image ratio is judged as being 20% or more (YES of S004), the number of the positive bias application by 0.5 (S007).

The control portion 150 then judges the ratio between the positive and negative bias application numbers from a (left) standing time (S008).

When the image forming apparatus 100 is left standing in the rest state for M times (3 days) or more, as described above in (4), the positively charged fog toner is increased. For this reason, when the rest state is kept for 72 hours or more (YES of S008), the control portion 150 increases the number of positive bias application by 0.5 (S009).

Then, the control portion 150 reads an output of a humidity detecting portion (environmental sensor) for detecting the humidity to determine an environmental humidity, from which the ratio between the positive and negative bias application numbers is judged (S010 and S012).

When the environmental humidity (relative humidity) is 20% or less, as described above in (5), the amount of the positively charged fog toner is decreased. For this reason, the control portion 150 decreases, when the environmental humidity is 20% or less (YES of S010), the number of positive bias application by 0.5 (S011). In this embodiment, with a boundary value of 20% for the environmental humidity, a result of study such that the ratio of amount between the positively charged fog toner and the negatively charged fog toner is changed is obtained. For that reason, the use of another value is of no problem when a particle size or the like of the toner is changed.

When the environmental humidity is 80% or more, as described above in (5), the amount of the positively charged fog toner is increased. For this reason, the control portion 150 increases, when the environmental humidity is 80% or more (YES of S012), the number of positive bias application by 0.5 (S013). In this embodiment, with a boundary value of 80% for the environmental humidity, a result of study such that the ratio of amount between the positively charged fog toner and the negatively charged fog toner is changed is obtained. For that reason, the use of another value is of no problem when a particle size or the like of the toner is changed.

As described above, weighting is provided to the application number ratio of the negative bias to the positive bias (8/2) in the 10 feeding intervals in the two cycles set in Embodiment 1. As a result, even in the case where the image forming condition is fluctuated, an optimum cleaning mode is executable with respect to the contamination of the secondary transfer roller 16.

A subsequent operation is performed in the same manner as in the control in Embodiment 1.

Incidentally, with respect to an adjusting unit amount (value) of the weighting, depending on a property of the developer, sensitivity to the cumulative sheet number, the image ratio, the standing time, and the environmental humidity varies, so that the adjusting unit amount is not limited to the above-described values. The adjusting unit amount should be optimized depending on the developer through an experiment.

Embodiment 2

Figure 10:
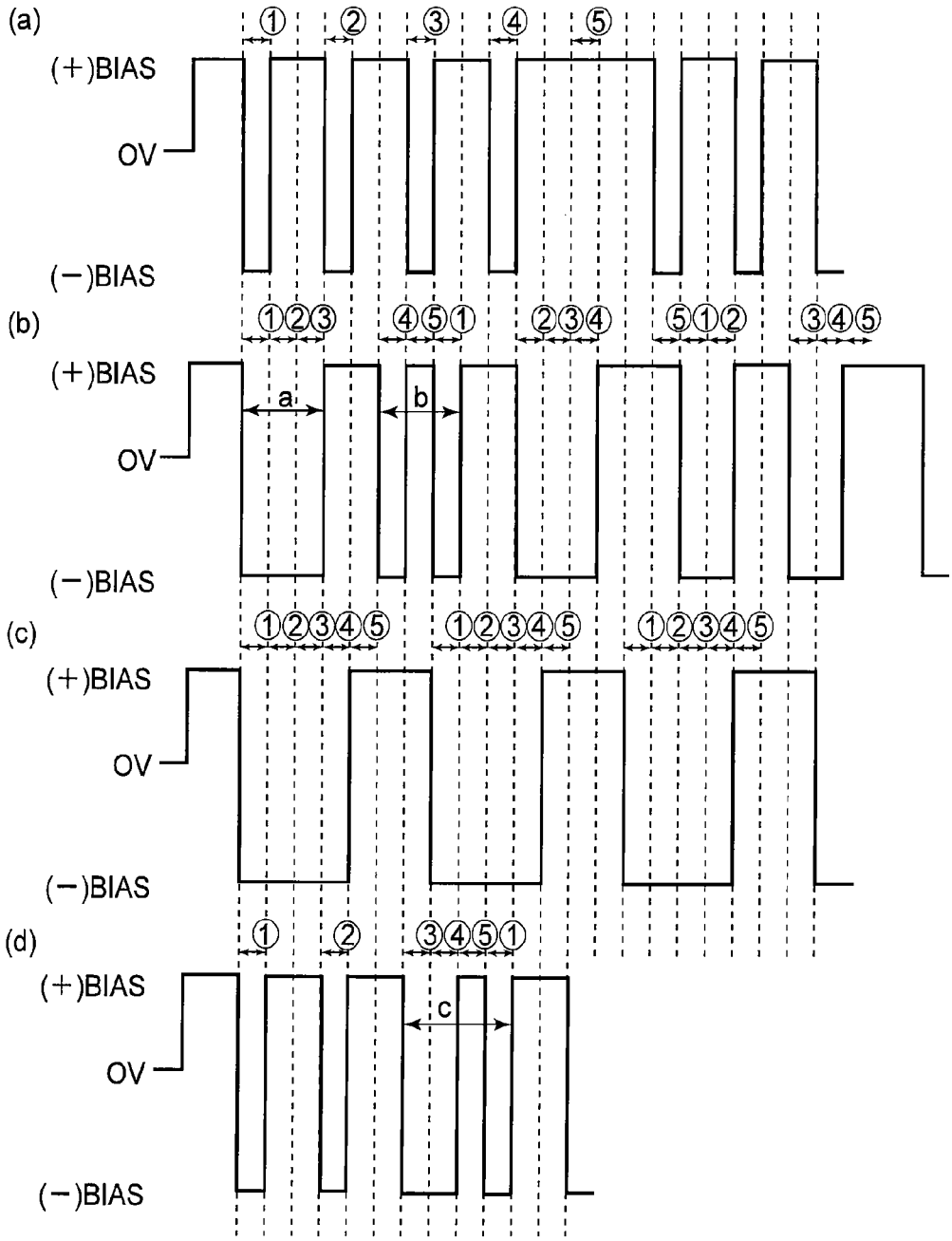
FIGS. 10(*a*) to 10(*d*) are timing charts of control in Embodiment 2.

FIGS. 10(*a*) to 10(*d*) are timing charts of control in Embodiment 2.

In Embodiment 1, each feeding interval of the recording material is kept constant at 100 mm and is larger than the peripheral length (75 mm) of the secondary transfer roller 16 and at each feeding interval, the bias of the same polarity is continuously applied to the secondary transfer roller 16.

In Embodiment 2, the feeding interval of the recording material is set variably depending on the type of the recording material. In the case where the recording material feeding interval exceeds 200 mm, the positive bias is applied to the secondary transfer roller 16 in a length up to the peripheral length+$\alpha$ (100 mm), so that excessive regular polarity fog toner is prevented from being transferred onto the secondary transfer roller 16. Further, at the feeding interval except for a length corresponding to the peripheral length of the secondary transfer roller 16, the negative bias is applied, so that the number of occurrences of feeding intervals in one cycle is decreased as small as possible.

In Embodiment 2, at the same feeding interval, the ratio of bias application numbers between the positive bias and the negative bias is set in a variable manner. During the continuous image formation for continuously forming the image on the recording material, the transfer member is cleaned by being supplied with a voltage between two image forming operations (at the feeding interval) and the proportion of the cleaning mode selected between the two image forming operations (at the feeding interval).

In the image forming apparatus meeting the POD market, productivity was enhanced by reducing the recording material feeding interval as short as possible while increasing the process speed. However, it is desired that the image forming apparatus can meet various recording materials different in thickness or surface property even though the productivity is sacrificed to some extent.

Thick paper with a large basis weight and coated paper having a smooth surface has a large amount of heat adsorption in a process in which it passes through a fixing nip, so that the fixing device is lowered in temperature at an ordinary short feeding interval, thus causing fixing failure. For this reason, when the thick paper or the coated paper is used, the productivity is sacrificed and the recording material feeding interval is increased to about 200 mm. As a result, the fixing device is prevented from causing excessive temperature lowering.

In Embodiment 2, in order to ensure a necessary fixing temperature, in the case where the recording material feeding interval is increased, control for changing the bias polarity every feeding interval is switched to control for changing the bias polarity at one (each) feeding interval.

FIG. 10(*a*) shows the control for changing the bias polarity every feeding interval, and FIGS. 10(*b*) and 10(*c*) show the control for changing the bias polarity at one feeding interval.

As shown in FIG. 10(*a*), in the case where the recording material feeding interval is 100 mm, as described in Embodiment 1, the bias polarity is changed every feeding interval. The negative bias is applied to the secondary transfer roller 16 at four feeding intervals and then the positive bias is applied to the secondary transfer roller 16 at a subsequent one feeding interval.

As shown in FIG. 10(*b*), when the recording material feeding interval is increased to 300 mm, one cycle is set at 500 mm similarly as in Embodiment 1 and the positive and negative bias setting is made every feeding interval (100 mm). As a result, the ratio of bias application numbers between the positive bias and the negative bias is kept at a value equal to that in the case of FIG. 10(*a*).

That is, the negative bias is applied to the secondary transfer roller 16 at a first feeding interval of 300 mm and at a first 100 mm section of a second feeding interval. Then, at a section of 100 mm to 200 mm of the second feeding interval, the positive bias is applied to the secondary transfer roller 16. At a section of 200 mm to 300 mm of the second feeding interval and later, the bias polarity control using 500 mm as one cycle is similarly repeated.

As shown in FIG. 10(*c*), also when the recording material feeding interval is increased to 500 mm, one cycle is set at 500 mm and the positive and negative bias setting is made every feeding interval (100 mm). As a result, the ratio of bias application numbers between the positive bias and the negative bias is kept at a value equal to that in the case of FIG. 10(*a*).

That is, the negative bias is applied to the secondary transfer roller 16 at a first 400 mm section of a first feeding interval. Then, at a subsequent section of 400 mm to 500 mm of the first feeding interval, the positive bias is applied to the secondary transfer roller 16. Also at a section, the bias polarity control using 500 mm as one cycle is similarly repeated.

As shown in FIG. 10(*d*), even in the case where the recording material feeding interval is switched from 100 mm to 400 mm during the continuous image formation, one cycle is set at 500 mm similarly as in Embodiment 1 and the positive and negative bias setting is made every feeding interval (100 mm). As a result, the ratio of bias application numbers between the positive bias and the negative bias is kept at a value equal to that in the case of FIG. 10(*a*).

For example, in the case where first and second sheets are plain paper and a third sheet is thick paper, it is necessary to perform the fixing on a fourth sheet after the feeding interval is increased to 400 mm to restore the fixing temperature to the set fixing temperature.

Also in this case, the negative bias is applied to the secondary transfer roller 16 at a 400 mm section in total including a first feeding interval of 100 mm, a second feeding interval of 100 mm and a first 200 mm section of a third feeding interval. Then, at a section of 200 mm to 300 mm of the third feeding interval, the positive bias is applied to the secondary transfer roller 16. At a section of 300 mm to 400 mm of the third feeding interval and later, the bias polarity control using 500 mm as one cycle is similarly repeated.

According to the control in Embodiment 2, in the case where the recording material feeding interval in the continuous image formation is changed the bias polarity is controlled at one feeding interval, not every feeding interval, so that the cleaning of the secondary transfer roller 16 can be property effected.

According to the control in Embodiments 1 and 2, it is possible to effect the cleaning of the secondary transfer roller 16 depending on the charge amount distribution of the fog toner on the intermediary transfer belt 9, so that the occurrence of the backside contamination of the recording material is reduced without causing the lowering in productivity in the continuous image formation.

Embodiment 3

The setting of a relative time length relationship between a total time in which the first cleaning mode is executed and a total time in which the second cleaning mode is executed is not limited to those in Embodiments 1 and 2. The relative time length relationship is not necessarily required to exactly follow a relative amount relationship between the amount of the fog toner charged to the regular polarity and the amount of the fog toner charged to the opposite polarity at the non-image portion of the image bearing member. There is no need that the ratio of the relative time length relationship completely coincides with the ratio of the relative amount relationship by following the ratio of the relative amount relationship.

Embodiment 4

In Embodiments 1 to 3, the cleaning mode of the transfer member in the image forming apparatus in which the toner image formed on the photosensitive drum as the image bearing member is primary-transferred onto the intermediary transfer belt as the intermediary transfer member and then is secondary-transferred onto the recording material is described. However, the present invention is also applicable to the cleaning mode of the transfer member in the image forming apparatus in which the toner image formed on the photosensitive drum as the image bearing member is directly transferred onto the recording material.

That is, in Embodiment 4, the image forming apparatus including a toner image forming means for forming a toner image on the image bearing member, a transfer member for transferring the toner image from the image bearing member onto the recording material, and an executing portion for executing the first cleaning mode and the second cleaning mode. In the first cleaning mode, the transfer member is cleaned by being supplied with the voltage of identical polarity to the normal charge polarity of the toner during the non-image formation. In the second cleaning mode, the transfer member is cleaned by being supplied with the voltage of opposite polarity to the normal charge polarity of the toner during the non-image formation and of opposite polarity to that in the first cleaning mode.

In Embodiment 4, in such an image forming apparatus, similarly as in Embodiment 1, the executing portion changes the ratio between the time in which the first cleaning mode is executed and the time in which the second cleaning mode is executed, depending on an operation environment of the image forming apparatus.

In Embodiment 4, in the above-described image forming apparatus, similarly as in Embodiment 1, during the continuous image formation in which the image is continuously formed on the recording material, the voltage is applied to the transfer member between two image forming operations (feeding interval) to clean the transfer member. Then, depending on the operation environment of the image forming apparatus, the proportion of the cleaning mode selected between the two image forming operations (feeding interval) is changed.

As described above, in the image forming apparatus of the present invention, even when the ratio between the amount of the negatively charged fog toner and the amount of the positively charged fog toner is changed depending on the operation environment of the developing device, it is possible to alleviate a degree of the contamination of the transfer member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 022721/2009 filed Feb. 3, 2009, which is hereby incorporated by reference.

What is claimed is:

1. An image forming apparatus comprising:

an image bearing member;

toner image forming means for forming a toner image on said image bearing member;

a transfer member for transferring the toner image from said image bearing member onto a recording material at a transfer position;

an executing portion for executing a first cleaning mode in which said transfer member is cleaned by being supplied with a voltage of an identical polarity to a normal charge polarity of toner during a period in which there is no recording material at the transfer position and executing a second cleaning mode in which said transfer member is cleaned by being supplied with a voltage of an opposite polarity to the normal charge polarity of the toner during a period in which there is no recording material at the transfer position; and a control portion for changing a ratio between a first cleaning mode execution period and a second cleaning mode execution period depending on an operation environment of said image forming apparatus.

2. An apparatus according to claim 1, wherein during continuous image formation for successively forming an image on the recording material, said transfer member is cleaned by being supplied with a voltage during an interval between an image forming operation and a subsequent image forming operation, and wherein said control portion changes the ratio between the first cleaning mode execution period and the second execution period corresponding to the first cleaning mode and the second cleaning mode executed during the interval.

3. An apparatus according to claim 1, further comprising a developing device for developing with the toner an electrostatic latent image formed on said image bearing member, wherein the second cleaning mode execution period is increased with an increase in number of occurrences of image formation by said image forming apparatus.

4. An apparatus according to claim 1, further comprising an environment detecting portion for detecting an environment, wherein the first cleaning mode execution period is increased when a detected humidity is lowered.

5. An apparatus according to claim 1, wherein said image bearing member is an intermediary transfer belt for carrying the toner image.

6. An image forming apparatus comprising:

an image bearing member;

toner image forming means for forming a toner image on said image bearing member;

a transfer member for transferring the toner image from said image bearing member onto a recording material at a transfer position;

an executing portion for executing a first cleaning mode in which said transfer member is cleaned by being supplied with a voltage of an identical polarity to a normal charge polarity of toner during a period in which there is no recording material at the transfer position and executing a second cleaning mode in which said transfer member is cleaned by being supplied with a voltage of an opposite polarity to the normal charge polarity of the toner during a period in which there is no recording material at the transfer position; and a control portion for changing a ratio between a first cleaning mode execution period and a second cleaning mode execution period depending on an operation state of said image forming apparatus.

7. An apparatus according to claim 6, wherein during continuous image formation for successively forming an image on the recording material, said transfer member is cleaned by being supplied with a voltage during an interval between an image forming operation and a subsequent image forming operation, and wherein said control portion changes the ratio between the first cleaning mode execution period and the second execution period corresponding to the first cleaning mode and the second cleaning mode executed during the interval.

8. An apparatus according to claim 6, further comprising a developing device for developing with the toner an electrostatic latent image formed on said image bearing member, wherein the second cleaning mode execution period is increased with an increase in number of occurrences of image formation by said image forming apparatus.

9. An apparatus according to claim 6, wherein said control portion increases the first cleaning mode execution period when an image ratio of an image to be formed is decreased.

10. An apparatus according to claim 6, wherein said control portion increases the second cleaning mode execution time period when an image ratio of an image to be formed is increased.

11. An apparatus according to claim 6, wherein said image bearing member is an intermediary transfer belt for carrying the toner image.

* * * * *